US008807784B2

(12) United States Patent
Marquardt et al.

(10) Patent No.: US 8,807,784 B2
(45) Date of Patent: Aug. 19, 2014

(54) LUMINAIRES AND LIGHT ENGINES FOR SAME

(75) Inventors: Craig Eugene Marquardt, Covington, GA (US); Patrick A. Collins, Conyers, GA (US); Jie Chen, Snellville, GA (US)

(73) Assignee: ABL IP Holding LLC, Conyers, GA (US)

( * ) Notice: Subject to any disclaimer, the term of this patent is extended or adjusted under 35 U.S.C. 154(b) by 34 days.

(21) Appl. No.: 13/027,795

(22) Filed: Feb. 15, 2011

(65) Prior Publication Data

US 2012/0206912 A1 Aug. 16, 2012

(51) Int. Cl.
*F21V 7/20* (2006.01)

(52) U.S. Cl.
USPC ..... 362/218; 362/217.05; 362/217.06; 362/373

(58) Field of Classification Search
USPC ..... 362/218, 217.05–217.06
See application file for complete search history.

(56) References Cited

U.S. PATENT DOCUMENTS

| | | | | |
|---|---|---|---|---|
| D158,803 | S | 5/1950 | Russell | |
| D189,256 | S | 11/1960 | Rothman | |
| D431,876 | S | 10/2000 | Lewis | |
| 6,320,182 | B1 * | 11/2001 | Hubble et al. | 250/216 |
| D452,030 | S | 12/2001 | Collver | |
| D470,262 | S | 2/2003 | Yiu | |
| 6,641,284 | B2 * | 11/2003 | Stopa et al. | 362/240 |
| D492,809 | S | 7/2004 | Weitgasser | |
| D567,425 | S | 4/2008 | Yates | |
| D581,079 | S | 11/2008 | Mier-Langner | |
| D584,444 | S | 1/2009 | Lipson | |
| D604,885 | S | 11/2009 | Fored et al. | |
| D607,598 | S | 1/2010 | Xiao et al. | |
| D607,599 | S | 1/2010 | Zhou et al. | |
| 7,758,207 | B1 * | 7/2010 | Zhou et al. | 362/218 |
| D633,640 | S | 3/2011 | Wauters | |
| 2008/0212336 | A1 * | 9/2008 | Chae | 362/547 |
| 2008/0285277 | A1 * | 11/2008 | Chang et al. | 362/247 |
| 2008/0298058 | A1 * | 12/2008 | Kan et al. | 362/240 |
| 2009/0122541 | A1 * | 5/2009 | Suehiro et al. | 362/235 |
| 2010/0177514 | A1 * | 7/2010 | Liu et al. | 362/235 |

FOREIGN PATENT DOCUMENTS

| | | |
|---|---|---|
| WO | WO 2010084546 | 7/2012 |

OTHER PUBLICATIONS

Office Action for Canadian Application No. 2,731,820, mailed Jul. 18, 2012 (3 pages).

* cited by examiner

*Primary Examiner* — Sean Gramling
(74) *Attorney, Agent, or Firm* — Kilpatrick Townsend & Stockton, LLP

(57) ABSTRACT

Light engines for inclusion in luminaires. Some embodiments of the light engine include a heat sink, a reflector, and light emitting diodes. Some embodiments of the heat sink include perforations. The reflector includes a reflective surface that extends around at least a portion of the light emitting diodes. In some embodiments, a portion of the reflector is sandwiched between the light emitting diodes and the heat sink. In some embodiments, an end of the reflector terminates above the light emitting diodes to reduce the concentration of light directly above the light emitting diodes but rather distribute the light outwardly from the luminaire.

17 Claims, 9 Drawing Sheets

LUMINAIRES AND LIGHT ENGINES FOR SAME

FIELD OF THE INVENTION

Embodiments of the invention relate to luminaires and light engines for same.

BACKGROUND OF THE INVENTION

The use of light emitting diodes in luminaires is becoming more prevalent. However, light emitting diodes have thermal management issues in that they heat up and lose efficiency in the process. Moreover, the light from light emitting diodes is emitted at angles that can create hot spots (typically at nadir) above the light emitting diodes, rendering them undesirable in certain applications, such a uplight applications whereby light is directed onto the ceiling above the luminaire.

SUMMARY OF EMBODIMENTS OF THE INVENTION

Embodiments of this invention provide a light engine for inclusion in a luminaire. Some embodiments of the light engine include a heat sink, a reflector, and light emitting diodes. Some embodiments of the heat sink include perforations. The reflector includes a reflective surface that extends around at least a portion of the light emitting diodes. In some embodiments, a portion of the reflector is sandwiched between the light emitting diodes and the heat sink. In some embodiments, an end of the reflector terminates above the light emitting diodes to reduce the concentration of light directly above the light emitting diodes but rather distribute the light outwardly from the luminaire.

DETAILED DESCRIPTION OF EMBODIMENTS OF THE INVENTION

Figure 1:
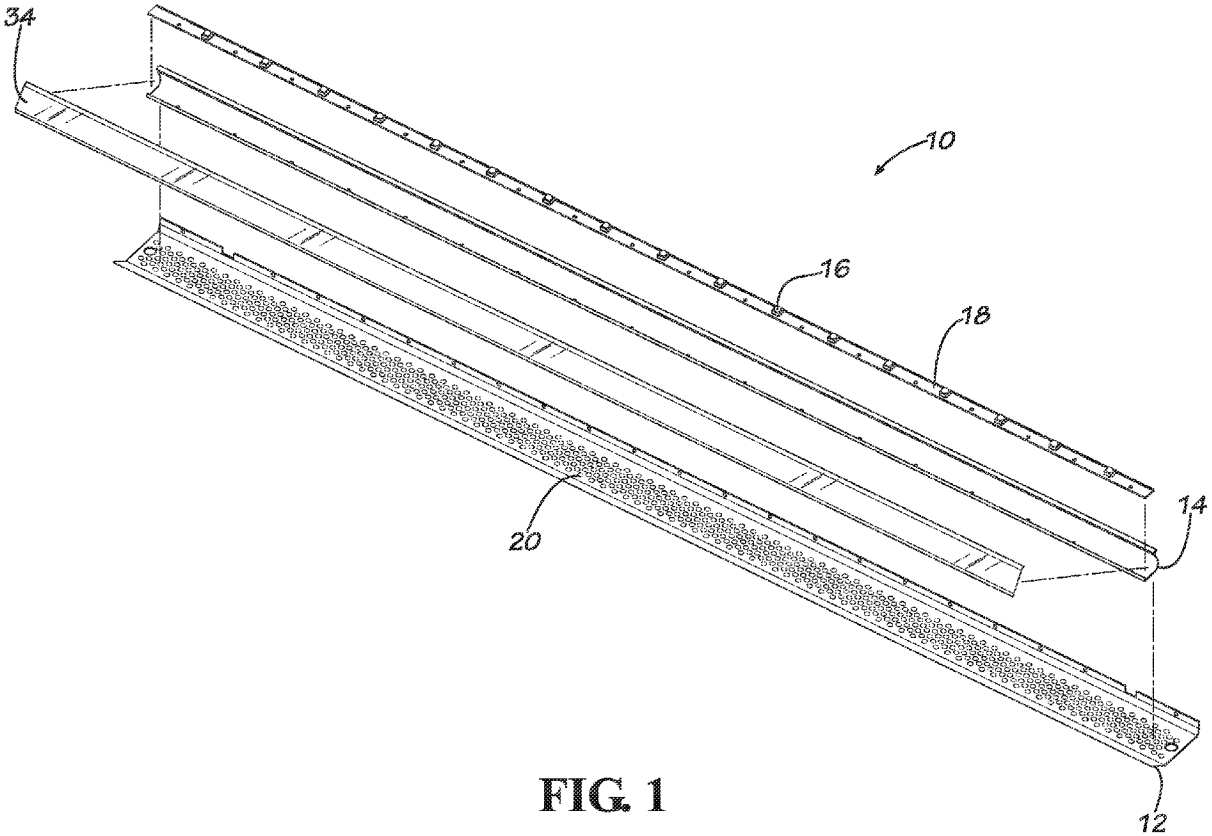
FIG. 1 is an exploded view of a light engine according to one embodiment of the invention.

Embodiments provide a light engine 10 particularly suitable, but certainly not limited, for use in luminaires for uplight applications (i.e., whereby the light emitted from the fixture is directed upwardly). In some embodiments, the light engine 10 includes a heat sink 12, a reflector 14, a plurality of light emitting diodes 16 mounted on a printed circuit board 18, and optionally an auxiliary optical component 34.

Embodiments of the heat sink 12 can be formed from any metallic material (such as, but not limited to, aluminum sheet metal) and can be perforated. Perforations 20 of any geometric shape are contemplated herein, including, but not limited to, square, circular, oval, rectangular, triangular, hexagonal, octagonal, etc.

Embodiments of the reflector 14 can also be formed of a metallic material (such as, but not limited to, aluminum) and can include a base 22, an arm 24 that extends upwardly from the base 22 and has a reflective surface 32, and two ends 26, 28 that define an opening 30 therebetween. The reflective surface 32 of the arm 24 may be of any shape but preferably is at least partially curved. In some embodiments, the reflective surface 32 is semi-parabolic in shape. In some embodiments, end 26 of the reflector arm 24 is designed to terminate above the light emitting diodes 16 positioned in the reflector 14 (as described below). In some embodiments, the reflector arm 24 terminates above the light emitting diodes 16 between 0° to 30° (inclusive) off nadir. In some embodiments, the reflector arm 24 terminates above the light emitting diodes 16 substantially at nadir.

The reflective surface 32 of the reflector 14 preferably has an extremely high surface reflectivity, preferably, but not necessarily, between 96%-99.5%, inclusive and more preferably 98.5-99%. To achieve the desired reflectivity, in one embodiment the reflective surface 32 comprises polished metals such as, but not limited to, polished aluminum. In some embodiments a reflective material for use in the reflector 14 comprises Miro® reflective aluminum materials, available from Alanod-Solar GmbH & Co. Alternative materials include micro cellular polyethylene ("MCPET"), available from Furukawa. In some embodiments, the reflectivity of the reflective surface 32 can be further enhanced by the application of reflective coatings, including reflective paints, or other reflective compositions. The reflective surface 32 may include a layer of a reflective flexible sheet of material such as one or more of the materials sold under the tradenames GL-22, GL-80, GL-30 or Optilon™, all available from DuPont.

Light emitting diodes 16 (mounted on a printed circuit board 18) are positioned on the base 22 of the reflector 14. The heat sink 12, reflector 14, and printed circuit board 18 may be secured together via any mechanical or chemical retention method. In one embodiment, they are fastened together with screws or other mechanical fasteners (not shown).

In use, when the light emitting diodes 16 emit light, approximately half of the light is emitted upwardly and outwardly unencumbered from the light engine 10. However, the light emitted from the side of the light emitting diodes 16 adjacent the reflector arm 24 encounters the reflective surface 32, which reflects the light to asymmetrically distribute it at high angles. In this way, the amount of light emitted directly above the light emitting diodes 16 is significantly reduced and redirected so as to avoid the appearance of a hot spot (an area where the light appears particularly bright) directly above the light emitting diodes (i.e., at nadir) but rather creates the appearance of a more even and uniform light distribution.

Embodiments of the light engine 10 described herein have unique thermal management properties built into their designs. First, use of a perforated heat sink 12 allows air to circulate up and intimately around the light emitting diodes 16 for convective cooling. Obviously the size, shape, and density of the perforations 20 provided in the heat sink 12 impact cooling efficiencies. Second, because the reflector base 22 is sandwiched between the heat sink 12 and the printed circuit board 18 (with associated light emitting diodes 16), the reflector 14 becomes an integral part of the heat sinking mechanism. Intimate contact between the reflector 14 and the printed circuit board 18 provides a direct path for conductive heat transfer away from the light emitting diodes 16.

Figure 2:
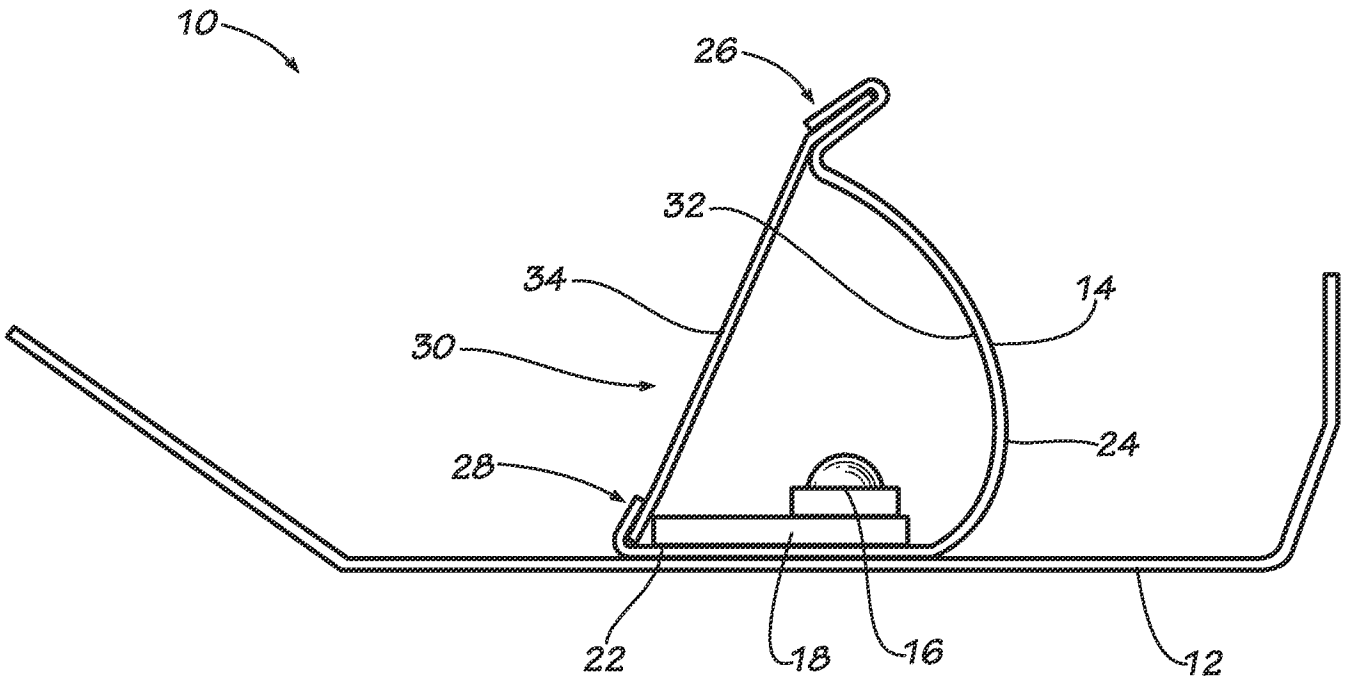
FIG. 2 is a side elevation view of the embodiment of the light engine shown in FIG. 1 assembled.
Figure 3:
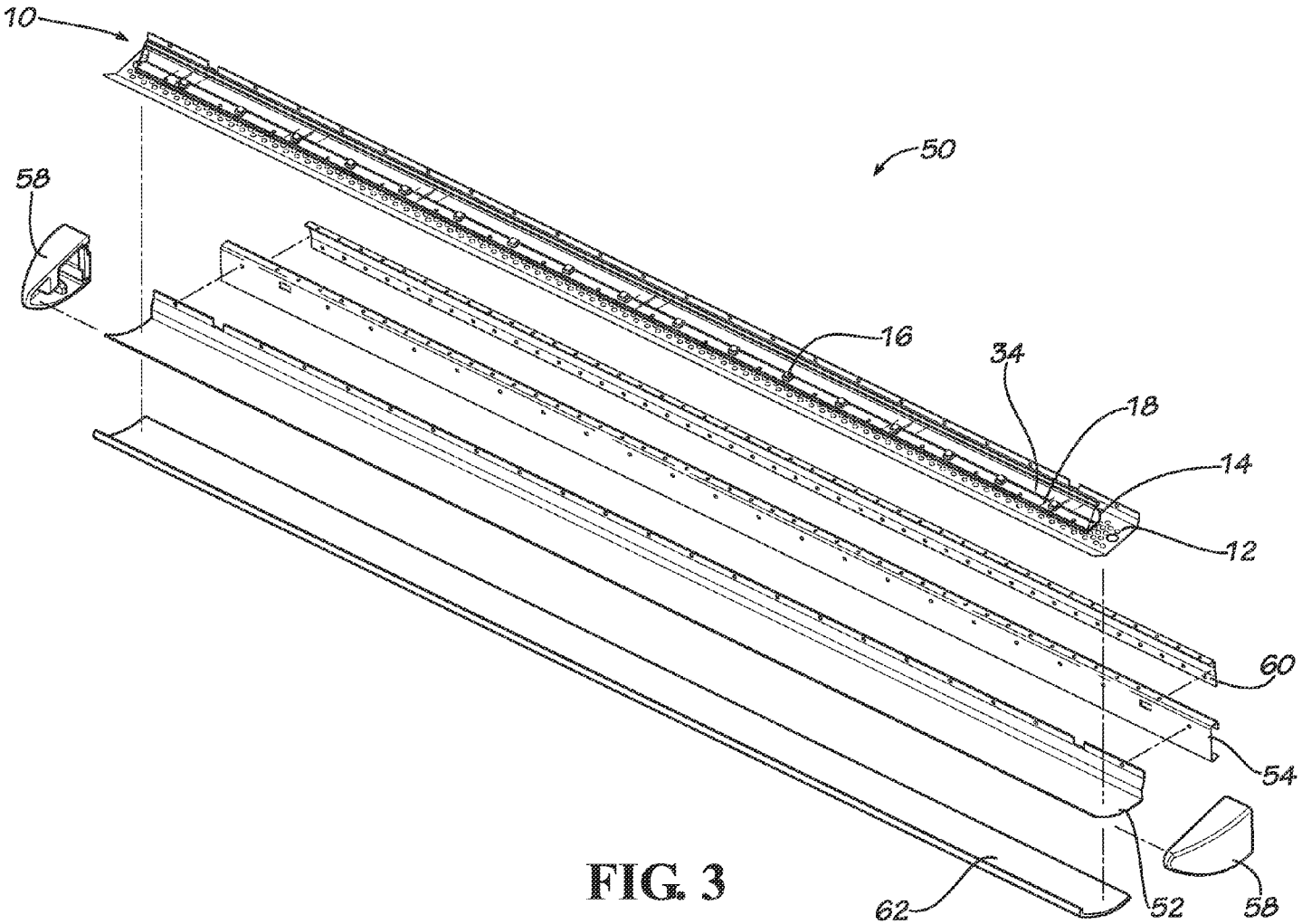
FIG. 3 is an exploded view of one embodiment of a luminaire that uses the embodiment of the light engine shown in FIG. 1.
Figure 4:
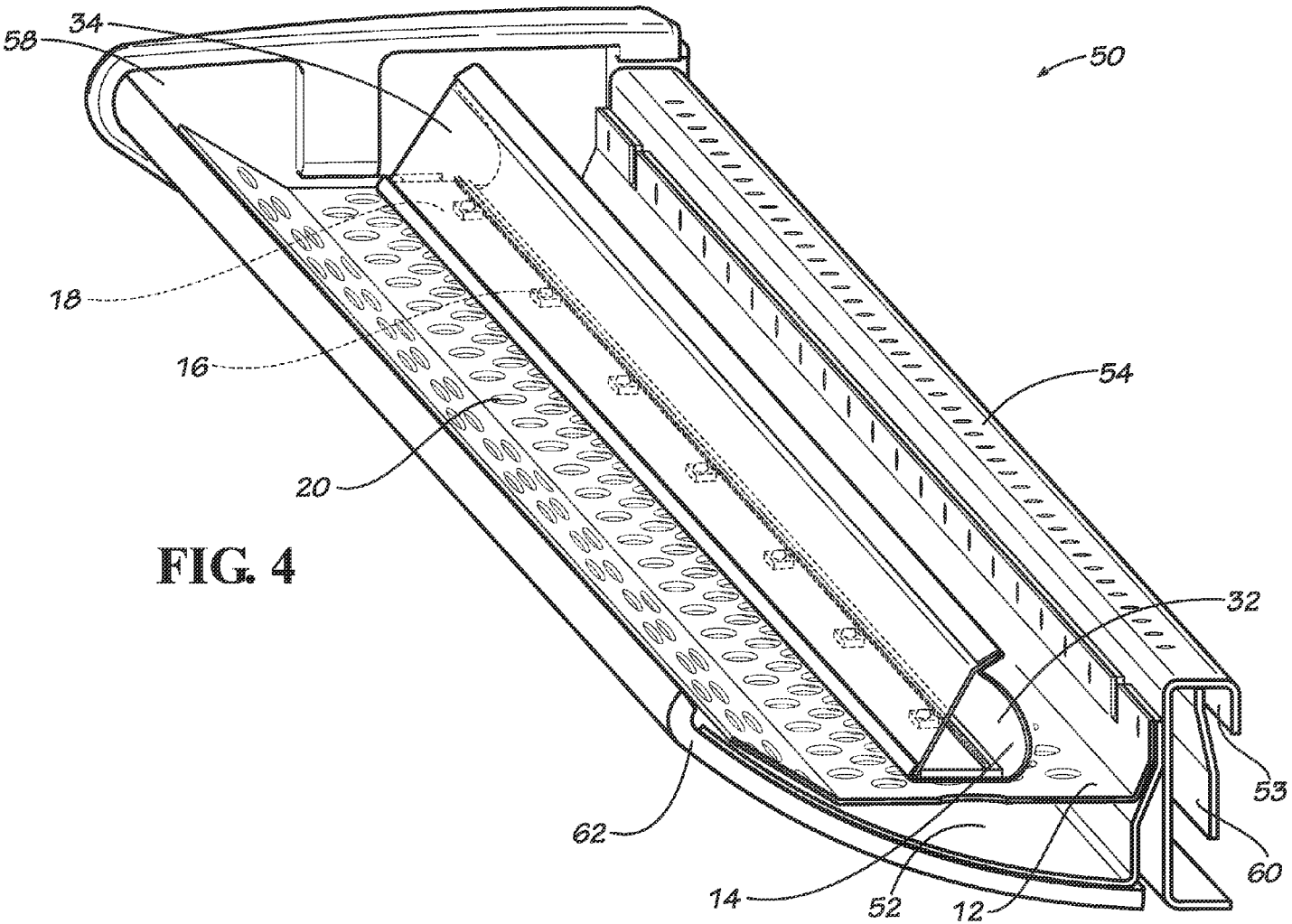
FIG. 4 is a top perspective view of the luminaire of FIG. 3 assembled but with an end cap removed.
Figure 5:
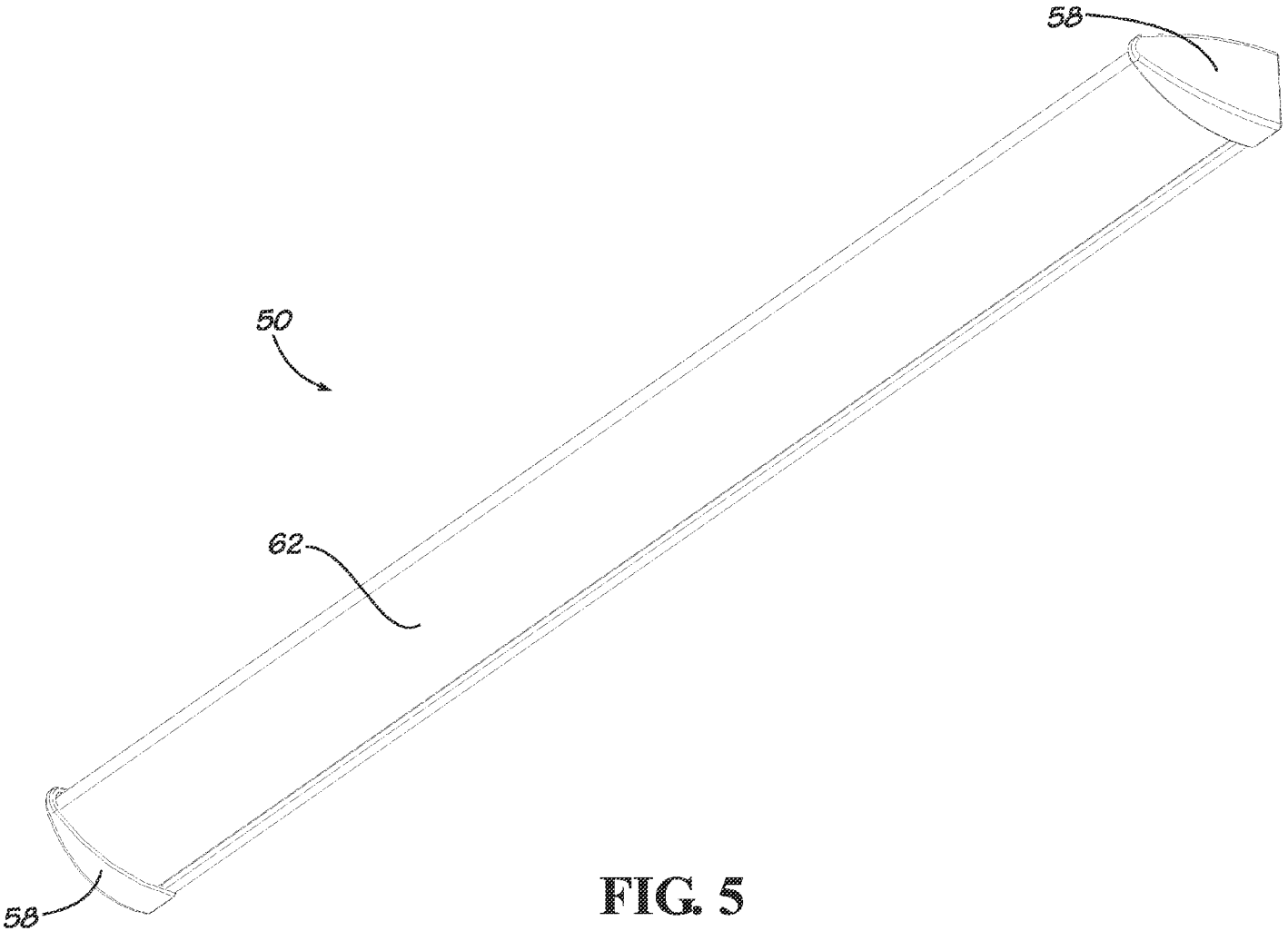
FIG. 5 is bottom perspective view of the luminaire shown in FIG. 3 assembled.
Figure 6:
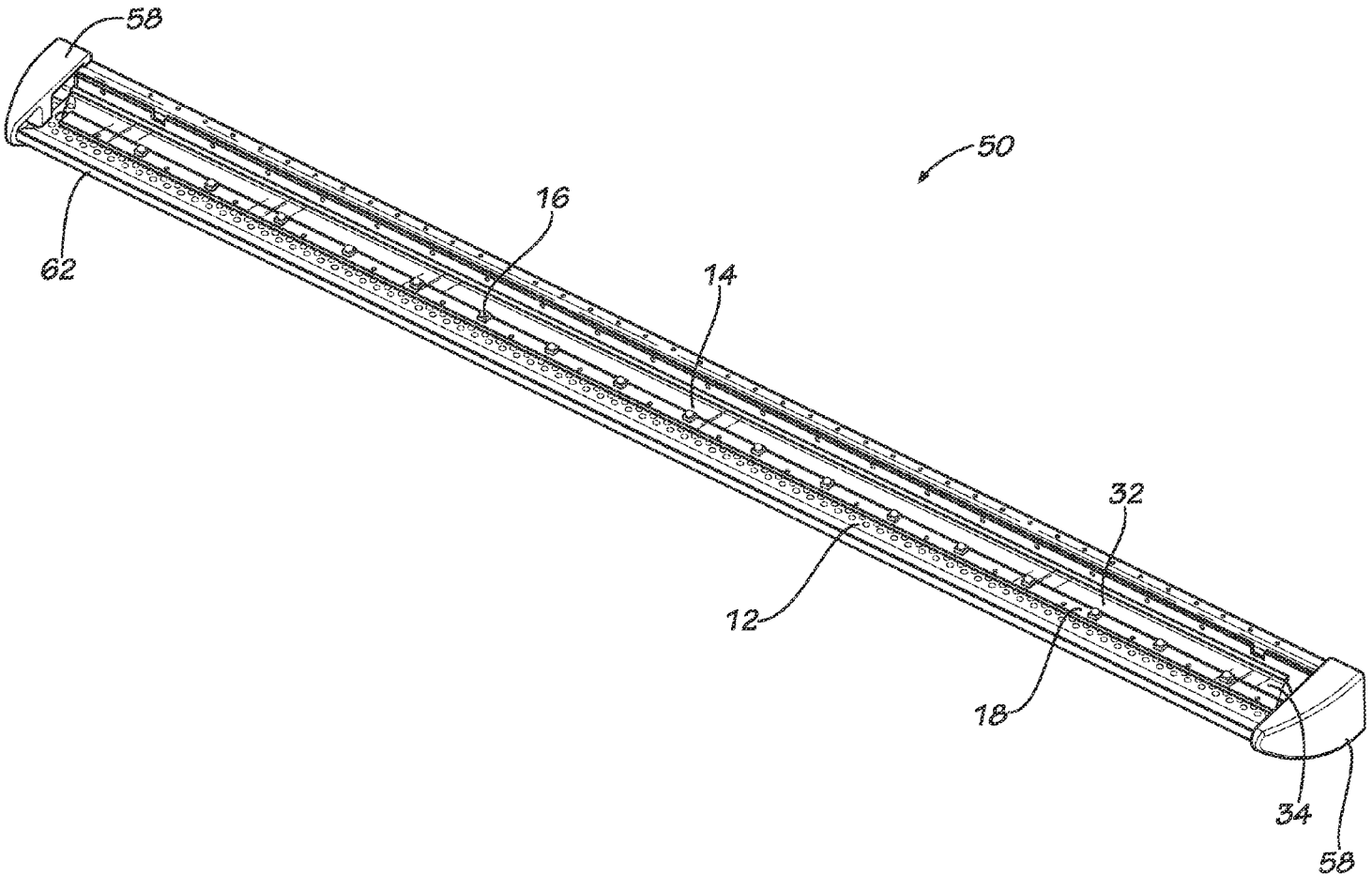
FIG. 6 is a top perspective view of the luminaire shown in FIG. 3 assembled.

The light engine 10 optionally may include auxiliary optical components. In one embodiment, a diffuser 34 is supported within the opening 30 between the two ends 26, 28 of the reflector 14 (see FIG. 2). Other optical components, including, but not limited to, films, lenses (perforated, colored, etc.), color filters, and obstruction media, may be so supported. One of skill in the art will understand that the diffuser 34 (or other optical component) can be supported by the reflector 14 in a variety of ways. In some embodiments, the diffuser 34 is snapped or slid between the ends 26, 28 of the reflector (see FIG. 2). While the diffuser 34 may be permanently affixed to the reflector 14, it may be desirable to attach the diffuser 34 to the reflector so as to be easily removable from the reflector 14. In this way, auxiliary optical components maybe be easily switched out or substituted in the light engine 10 to tailor or customize the light distribution and/or appearance emitted from the light engine.

In some embodiments, the diffuser 34 extends between the ends 26, 28 of the reflector 14 in a straight or a concave plane. However, as discussed below, in some applications it may be beneficial for the diffuser to bow convexly outwardly from the opening 30.

The light engine 10 may be incorporated into a variety of different types of luminaires, only a few of which are described and shown herein for purposes of illustration. It is by no means applicants intention to limit the utility of embodiments of the light engines 10 described herein to these illustrated luminaires. Moreover, the light engine 10 may be provided in any length or other dimension. Multiple light engines 10 (or components thereof) may be linearly arranged and electrically connected in a single luminaire.

FIGS. 3-6 illustrate an embodiment of a luminaire designed to be mounted on a wall to direct light upwardly from the luminaire (hereinafter "wall mount luminaire" 50). The wall mount luminaire 50 includes a base housing 52 and a back plate 54. The light engine 10 seats in the base housing 52 and the base housing 52, the light engine 10, and the back plate 54 may be secured together using any mechanical fastening means, including screws (not shown). End caps 58 are mounted on each end of the luminaire 50. The wall mount luminaire 50 may be mounted on the wall using any mechanical retention method, all of which are readily know by those of skill in the art. In the disclosed embodiment, a bracket 60 is mounted on the wall and the back plate 54 includes a hook 53 that engages the bracket to retain the wall mount luminaire on the wall (see FIG. 4). When so mounted, the bottom of the base housing 52 is visible from the floor. It may be desirable, but certainly not required, to provide an aesthetically pleasing decorative cover 62 below the base housing 52. Such a cover 62 might be wood, glass, acrylic, etc.

When the wall mount luminaire 50 is mounted on the wall and in use, the light emitting diodes 16 are oriented upwardly in the luminaire 50. As described above, approximately half of the light emitted from the wall mount luminaire 50 is emitted upwardly and outwardly from the luminaire 50 (i.e., onto the ceiling in a direction away from the wall). The other approximate half of the light emitted from the light emitting diodes 16 encounters the reflector 14, which emits the light at a high angle to reduce the concentration of light directly above the luminaire 50 (and thus avoid hot spots) but rather distribute the light, and thereby increase the brightness, outwardly across the ceiling. Because the wall mount luminaire 50 is an open fixture, heat generated by the light emitting diodes 16 is able to dissipate from the fixture. Heat dissipation is facilitated by the convective cooling effect of the perforated heat sink 12 as well as the conductive cooling effect of the reflector 14, as described above.

As alluded to earlier, it may be beneficial to incorporate an auxiliary optical component, such as a diffuser 34, into the light engine 10. The diffuser 34 may be retained by the reflector 14, as discussed above. It may be desirable, but certainly not required, to position the diffuser 34 in the reflector 14 so that the diffuser 34 bows outwardly from the reflector 14. In this way, the diffuser 34 is able to direct light onto the wall above the luminaire.

Figure 7:
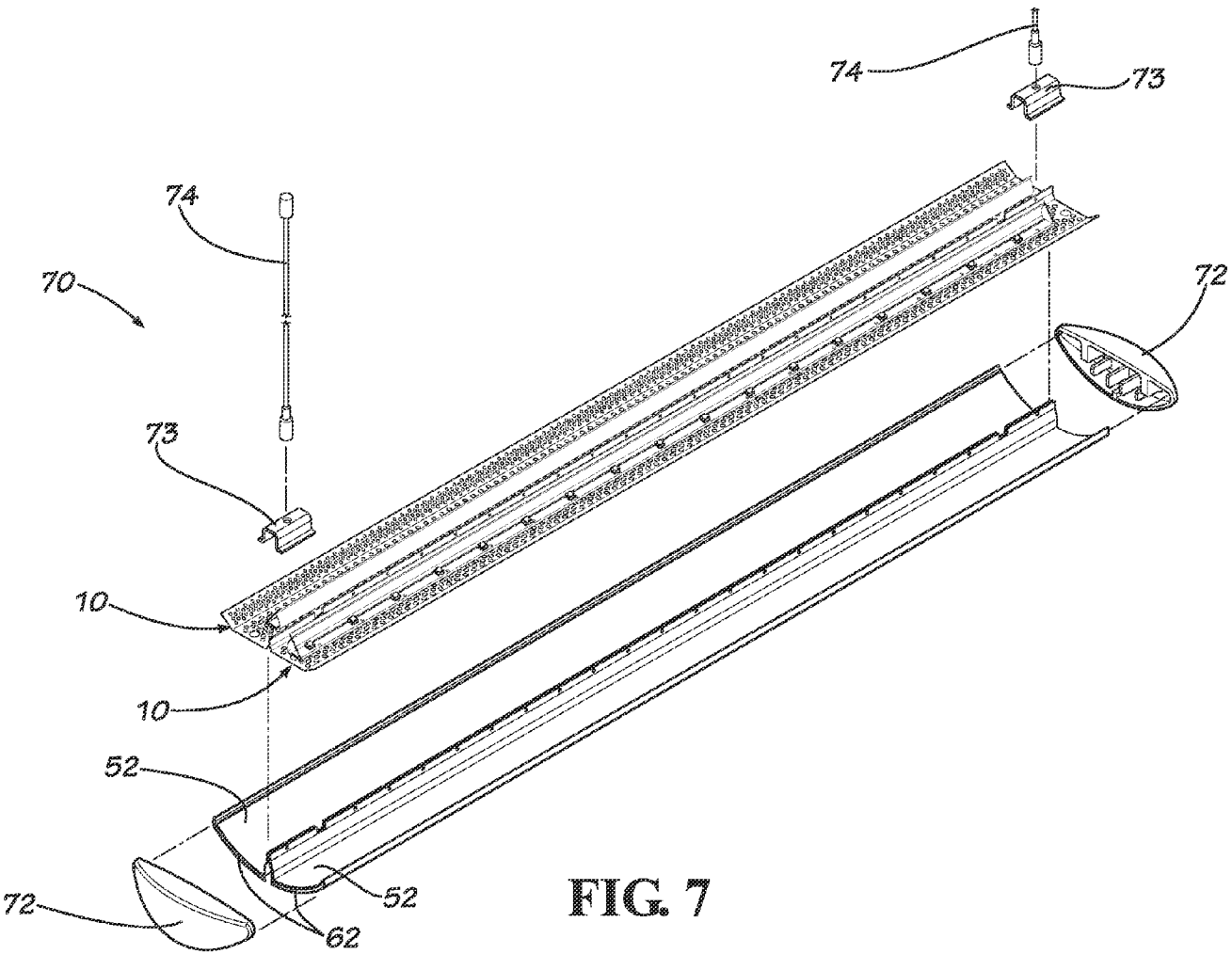
FIG. 7 is an exploded view of another embodiment of a luminaire that uses the embodiment of the light engine shown in FIG. 1.
Figure 8:
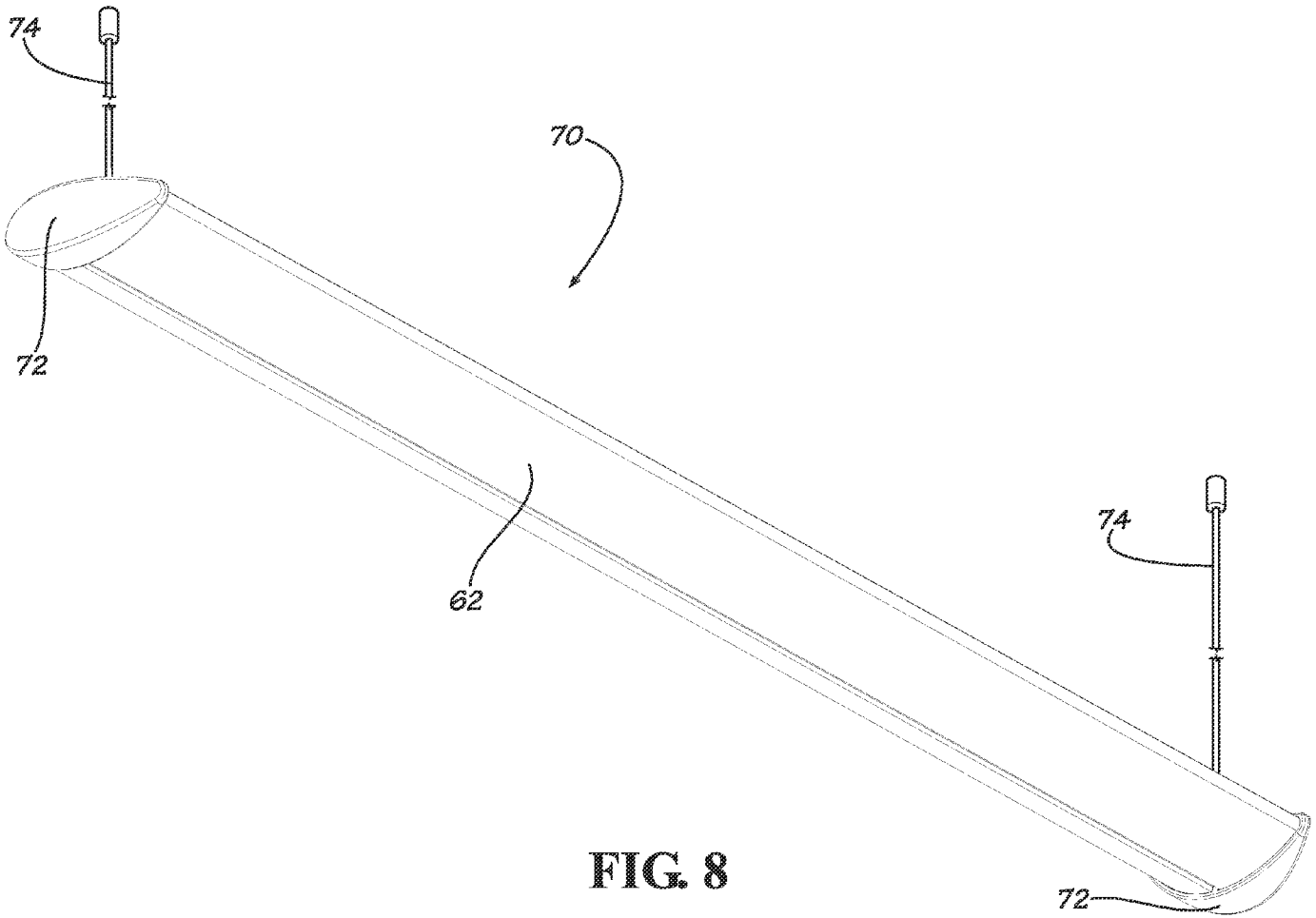
FIG. 8 is bottom perspective view of the luminaire shown in FIG. 7 assembled.
Figure 9:
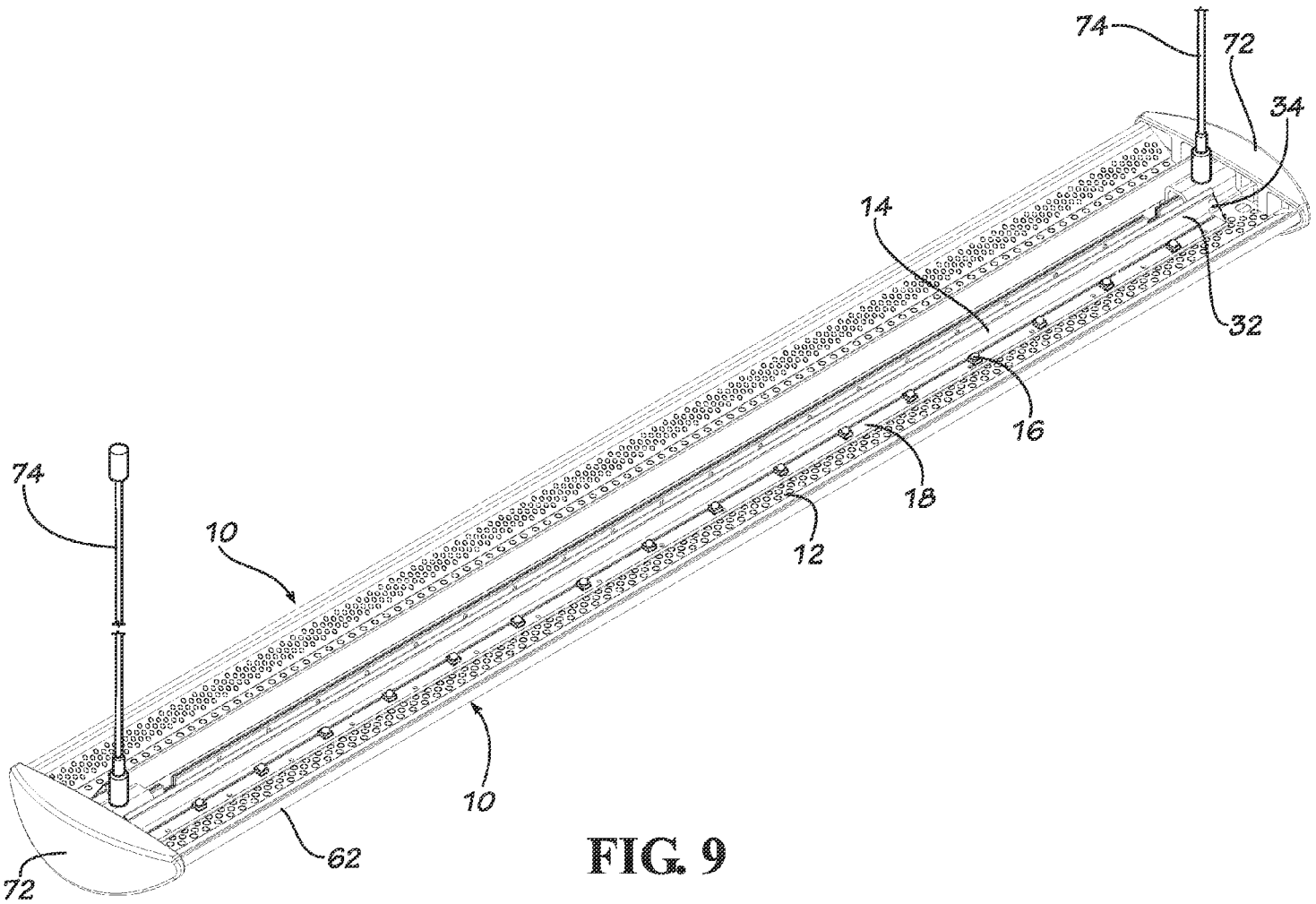
FIG. 9 is a top perspective view of the luminaire shown in FIG. 7 assembled.

FIGS. 7-9 illustrate another embodiment of a luminaire 70 in which embodiments of the light engine 10 described herein may be used. The luminaire 70 illustrated in FIGS. 7-9 is a pendant uplight that is suspended from the ceiling. It is noteworthy that the same base housing 52 and light engine 10 (as well as optional cover 62) used in the wall mount luminaire 50 can be used in the pendant luminaire 70. To create the pendant luminaire version, essentially two light engines 10 and two base housings 52 are positioned back to back (see FIG. 7) and secured together to each make up a half of the pendant luminaire 70. End caps 72 designed for the pendant luminaire 70 are provided on the ends of the luminaire 70. Moreover, clips 73 may span adjacent light engines 10. Suspension means for the luminaire 70 (such as cables or stems 74) may engage clips 73 to suspend the pendant luminaire 70 from the ceiling. Obviously, one of skill in the art will understand that a variety of different mechanical structures may be used to suspend the luminaire 70.

Because the light engines 10 and base housings 52 of each of the wall mount 50 and the pendant luminaires 70 can be identical, the manufacturer need only manufacture one assembly of them and the supplier need only stock one such assembly. A wall mounting kit (which would include the wall bracket 60 and the wall mount end caps 58) would be provided if the wall mount luminaire 50 was requested by a purchaser. In contrast, a pendant mounting kit (which would include clips 73, the cables or stems 74 (or other means by which to suspend the fixture from the ceiling), and the pendant end caps 72) would be provided if the pendant luminaire 70 was requested by the purchaser.

In use, light emitted from the light emitting diodes 16 in the pendant luminaire 70 is distributed substantially outwardly from both sides of the fixture so as to avoid the creation of hot spots on the ceiling directly above the luminaire but rather widely spread the light onto the surrounding ceiling space. Different auxiliary optical components (e.g., a diffuser) may be coupled to the reflector 14 to tailor the distribution into a specific architectural space to achieve smooth uniformities typically not achievable with traditional sources. It may be desirable, but certainly not required, to position the diffuser 34 in the reflector 14 so that the diffuser 34 bows outwardly from the reflector 14. In this way, the diffuser 34 on each side of the pendant luminaire 70 is able to direct light onto the ceiling between the two sides of the pendant luminaire 70 where a dark spot might appear otherwise. In this way, the diffusers 34 help to merge the light on each side of the pendant luminaire 70 to create a uniform distribution of light above the pendant luminaire.

The distributions attained by use of the light engines 10 disclosed herein render such light engines 10 particularly suitable for use in fixtures positioned in close proximity (e.g., 12 to 18 inches) to the ceiling. Such distributions emit a far-reaching, uniform pattern of light across the ceiling which permits wide spacing between adjacent luminaires (e.g., spacing from 10 to 14 feet) while maintaining ceiling uniformities better than 3 to 1 max to min and maintaining high luminaire efficiencies typically above its florescent counterparts.

We claim:

1. A luminaire comprising at least one light engine comprising:

a. a reflector comprising a linear base and a reflective surface that extends from the base, wherein the base comprises a thickness, a length, and a width that is greater than the thickness of the base;

b. at least one light emitting diode mounted on a linear LED mounting substrate, wherein the LED mounting substrate is mounted on the base of the reflector so as to extend at least partially across the width of the reflector base and at least partially along the length of the reflector base; and c. a heat sink comprising a linear substrate having a plurality of perforations that extend entirely through the substrate and that are oriented within the luminaire to permit air to flow through at least some of the plurality of perforations and past the at least one light emitting diode to thereby cool the at least one light emitting diode, wherein at least a portion of the reflector base is sandwiched between the LED mounting substrate and the linear substrate of the heat sink.

2. The luminaire of claim 1, wherein at least a portion of the reflective surface is curved and extends around at least a portion of the at least one light emitting diode.

3. The luminaire of claim 2, wherein an end of the reflective surface terminates above the at least one light emitting diode between 0° to 30° off nadir, inclusive.

4. The luminaire of claim 3, wherein an end of the reflective surface terminates above the at least one light emitting diode substantially at nadir.

5. The luminaire of claim 1, wherein at least a portion of the reflective surface is semi-parabolic in shape.

6. The luminaire of claim 1, wherein the at least one light emitting diode comprises a linear array of light emitting diodes.

7. The luminaire of claim 1, wherein the reflector further comprises two ends and an opening defined between the two ends and wherein the light engine further comprises an optical element positioned at least partially within the opening between the two ends of the reflector.

8. The luminaire of claim 7, wherein the optical element curves outwardly from the opening.

9. The luminaire of claim 7, wherein the optical element is removably retained within the opening.

10. The luminaire of claim 1, wherein the reflector asymmetrically distributes from the light engine light emitted by the at least one light emitting diode.

11. The luminaire of claim 1, wherein the luminaire is oriented such that the at least one light emitting diode of the at least one light engine is positioned in the luminaire to emit light toward a ceiling.

12. The luminaire of claim 1, wherein the at least one light engine comprises a first light engine and a second light engine and wherein the first and second light engines are situated in the luminaire so as to direct light onto a ceiling in substantially different directions.

13. A luminaire comprising at least one light engine comprising:

a. at least one light emitting diode mounted on a linear LED mounting substrate;

b. a reflector comprising a linear base and a curved reflective surface that extends from the base, wherein the base comprises a thickness, a length, and a width that is greater than the thickness of the base, wherein the LED mounting substrate is retained on the base and wherein the curved reflective surface extends at least partially around the at least one light emitting diode; and c. a heat sink comprising a linear substrate having a plurality of perforations that extend entirely through the substrate and that are oriented within the luminaire to permit air to flow through at least some of the plurality of perforations and past the at least one light emitting diode to thereby cool the at least one light emitting diode, wherein at least a portion of the reflector base is sandwiched between the LED mounting substrate and the linear substrate of the heat sink.

14. The luminaire of claim 13, wherein the luminaire is oriented such that the at least one light emitting diode of the at least one light engine is positioned in the luminaire to emit light toward a ceiling.

15. The luminaire of claim 13, wherein the at least one light engine comprises a first light engine and a second light engine and wherein the first and second light engines are situated in the luminaire so as to direct light onto a ceiling in substantially different directions.

16. The luminaire of claim 13, further comprising a housing into which the at least one light engine seats.

17. The luminaire of claim 13, further comprising end caps positioned on a first and second end of the luminaire.

* * * * *